United States Patent [19]

Last

[11] Patent Number: 4,523,647

[45] Date of Patent: Jun. 18, 1985

[54] POWER HAMMER

[75] Inventor: Anthony E. W. Last, Charlotte, N.C.

[73] Assignee: International Construction Equipment, Inc., Matthews, N.C.

[21] Appl. No.: 475,762

[22] Filed: Mar. 16, 1983

[51] Int. Cl.[3] ..... B25D 9/00

[52] U.S. Cl. ..... 173/133; 173/128; 173/134

[58] Field of Search ..... 173/133, 139, 137, 128, 173/132, 134; 92/85 B, 85 R

[56] References Cited

U.S. PATENT DOCUMENTS

| | | | |
|---|---|---|---|
| 3,266,581 | 8/1966 | Cooley et al. | 173/139 |
| 3,625,295 | 12/1971 | Gunning | 173/133 X |
| 4,089,380 | 5/1978 | Hibbard | 173/133 |
| 4,257,488 | 3/1981 | Schnell | 173/133 |
| 4,340,120 | 7/1982 | Hauk et al. | 173/133 X |
| 4,363,365 | 12/1982 | Nikolaev et al. | 173/139 X |
| 4,427,078 | 1/1984 | Wolters et al. | 173/139 X |

*Primary Examiner*—E. R. Kazenske
*Assistant Examiner*—Willmon Fridie, Jr.
*Attorney, Agent, or Firm*—Richards, Shefte & Pinckney

[57] ABSTRACT

A power hammer for driving piles and the like which includes a housing having a ram carried therein for reciprocating vertical movement to strike, during its downward movement, an anvil slidably carried within the lower portion of the housing. The portion of the housing in which the anvil is carried is formed with an annular recess, and the anvil includes an annular flange projecting into the recess to form an enclosed chamber beneath such flange. Air pressure generated by the ascendency of the ram is transmitted to the enclosed chamber to impose an upwardly directed force on the anvil whereby the weight of the anvil is utilized to oppose the upwardly directed force imposed on the power hammer during the ascending movement of the ram. The anvil flange is positioned in the recess to close the fluid inlet thereto when there is any significant downward movement of the anvil relative to the housing, so that the air in the enclosed chamber is trapped to provide an air cushion which reduces any impact load that may be transmitted from the anvil to the housing.

6 Claims, 2 Drawing Figures

POWER HAMMER

BACKGROUND OF THE INVENTION

This invention relates to power hammers used for driving piles, for breaking rocks and pavement, and for similar purposes.

Known power hammers of this type typically include a vertical housing having a cylinder in which a heavy ram or piston is arranged for vertical, reciprocating movement, and a relatively heavy anvil is carried within the lower portion of the housing so that it will be struck by the full force of the ram during its downward movement, and this impact force is transmitted by the anvil to the object being driven or crushed, usually through intermediate components such as a striker block and a drive cap when the object to be driven is a pile.

A combustion chamber is formed within the cylindrical housing between the lower surface of the ram and the upper surface of the anvil, and fuel and air are introduced into the combustion chamber by appropriate valving. Once started, the downward movement of the ram causes compression and heating of the air within the combustion chamber so that the fuel is ignited, and the force of combustion causes the ram to be pushed upwardly in the housing to its uppermost position, whereupon gravity overcomes such force and then the ram again moves downwardly to strike the anvil, and this cycle is repeated continuously.

To reduce the stroke of the ram and, therefore, the length of a power hammer, and to increase the striking rate of the hammer, it is now common practice to also provide the housing of the hammer with an associated compression or "bounce" chamber which communicates with the housing above the ram so that during the aforesaid upward movement of the ram air is forced into the bounce chamber and compressed, and this compressed air is then utilized to combine with the weight of the ram to drive it downwardly against the anvil.

Typical examples of conventional power hammers of the foregoing type are described in greater detail in U.S. Pat. Nos. 3,437,157 and 4,020,804.

In this conventional type of power hammers, the upward movement of the ram within the housing, and the attendant compression of air above the ram and within the bounce chamber, creates an upwardly directed force against the top of the housing which tends to lift the hammer off of the pile being driven. This upwardly directed force is resisted only by the overall weight of the hammer, and it is particularly significant to note that the weight of the anvil, which is relatively heavy (e.g. over 2,000 pounds in larger hammers), is not utilized in opposing such upward force because it must be arranged within the cylindrical housing for relative sliding movement with respect thereto to avoid transmitting destructive impact forces directly to the housing when the anvil is struck by the ram. Thus, the anvil generally rests upon the striker block, which is situated on the pile through a drive cap attachment, and the anvil, in effect, simply floats within the cylindrical housing during upward movement of the ram so that the weight of the anvil is not added to the weight of the hammer as a whole to oppose the upwardly directed forces generated by the ram being driven upwardly by the combustion forces in the combustion chamber. Accordingly, if such upward force is of a magnitude that may lift the hammer off of the object being driven or worked upon, the generally accepted solution to this problem has been to substantially increase the weight of the power hammer housing, which has the disadvantage of correspondingly increasing the cost of the equipment as well as rendering the equipment more difficult to handle and transport.

Additionally, most power hammers include an anvil retainer that is connected to the housing by bolts and that is provided with some projecting flange or the like which will engage the anvil and retain it in the housing when the anvil reaches its lowermost position in the housing. In many operations the relative movement of the anvil within the housing is small and the anvil seldom reaches its lowermost position, but in some operations, such as when a pile is driven into soft earth, the anvil will strike the anvil retainer and impose shock loads on the bolts which connect the anvil retainer to the housing. To alleviate this impact transmission problem, stacked disc washers have been placed between the anvil retaining portion of the housing and the heads of the bolts which connect the anvil retainer to the housing to absorb some of the shock load imposed on the anvil retainer. However, such mechanical shock absorbers are subject to wear in time, and increase the maintenance problems and costs associated with the equipment.

In accordance the present invention, the foregoing drawbacks of known power hammers are overcome by a unique arrangement through which the weight of the anvil is utilized to oppose the upwardly directed forces created by the ascending ram, while also providing an air cushion to absorb shock forces that might otherwise be imposed on the anvil retainer when the anvil is struck by the ram.

SUMMARY OF THE INVENTION

In the present invention, a power hammer having a housing, ram and anvil as described above is improved by providing an enclosed chamber formed between the housing and a portion of the anvil, and the pressure of the fluid in such chamber is varied during the upward stroke of the ram whereby, during such movement of the ram, the weight of the anvil is utilized to effectively increase the total weight of the power hammer to oppose the lifting force imposed on the power hammer by the ascending ram.

In the preferred embodiment of the present invention, the enclosed chamber is formed by an annular recess in the portion of the housing containing the anvil such as the anvil retainer, and by an annular flange extending radially from the side wall of the anvil and into the recess of housing. A conduit is provided between the compression cylinder, or bounce chamber, and the enclosed chamber to permit pressurized air in the compression chamber to be transmitted to the enclosed chamber whenever the pressure in the compression chamber is higher than the pressure in the enclosed chamber, and a valve, preferably a check valve, may be provided in such conduit to prevent the pressurized air from flowing back from the enclosed chamber to the compression cylinder. The surface area of the anvil flange is preferably selected to combine with the maximum pressure created in the enclosed chamber to provide a desired upward force, whereby the anvil will not move upwardly in the cylinder but at least a portion of the weight of the anvil will be combined with the weight of the other elements of the power hammer in opposing the upward force created by the ascending ram.

Additionally, the inlet opening that admits air to the enclosed chamber is located just below the normal position of the anvil flange within the enclosed chamber so that downward movement of the anvil, upon being struck by the ram, will cause the flange to close the opening and seal the enclosed chamber, and the air trapped in the chamber will act as an air cushion to assist in absorbing some of the shock load between the anvil retainer portion of the housing and the anvil.

In an alternative embodiment of the present invention, the upward force imposed on the anvil is created by a vacuum or negative pressure in a chamber above the annular flange of anvil. This negative pressure may be utilized with or without the positive pressure described above.

DESCRIPTION OF THE PREFERRED EMBODIMENT

Figure 1:
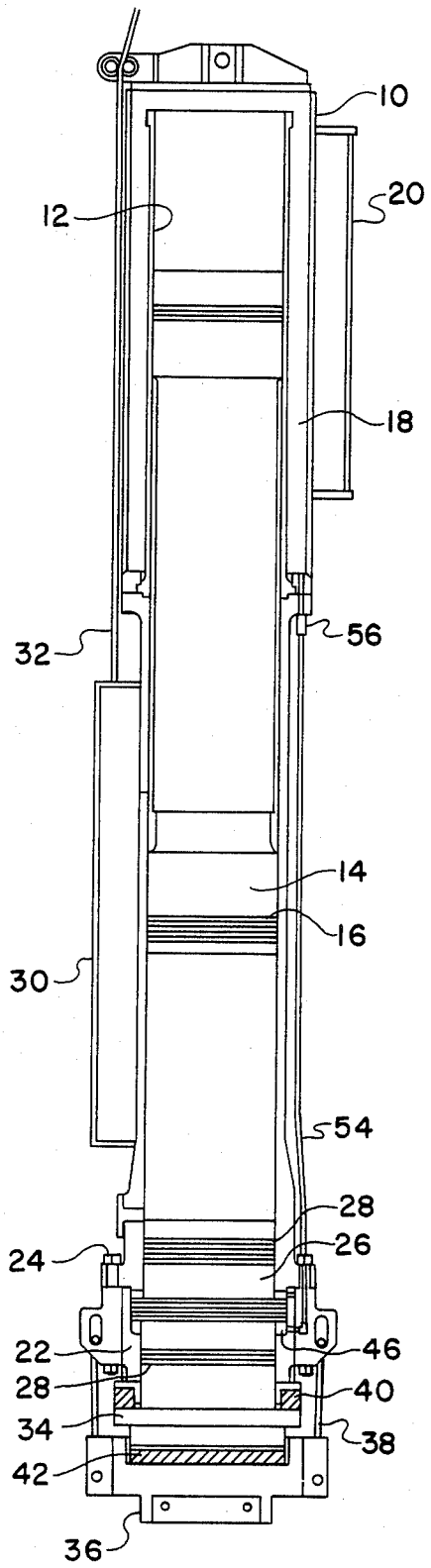
FIG. 1 is a diagrammatic vertical section view of a power hammer embodying the present invention.

Looking now in greater detail at the accompanying drawings, FIG. 1 is a diagrammatic illustration of a power hammer which includes a housing 10 formed with a cylindrical bore 12 in which a piston or ram 14 is carried for vertical reciprocating movement therein, the ram 14 being provided with annular rings 16 to provide a close fit between the interior cylindrical surface of the bore 10 and the ram 14 during reciprocating movement thereof. The upper end of the housing 10 includes a compression cylinder, or bounce cylinder 18 that is in direct communication with the open upper end of the bore 12, and a fuel tank 20 is provided adjacent the top of the housing 10. The housing 10 includes an anvil retainer 22 that is connected to the lower end thereof by a plurality of bolts 24 (see FIG. 2) so that the interior cylindrical surface of the anvil retainer 22 forms a continuation of the bore 12, and an anvil 26 is carried thereat, the anvil 26 including a plurality of annular sealing rings 28 which engage the interior surfaces of the bore 12 and anvil retainer 22, respectively. Finally, the housing 10 includes a starter assembly 30 having an associated lifting cable 32 for initially raising the ram 14 to commence operation of the power hammer.

Figure 2:
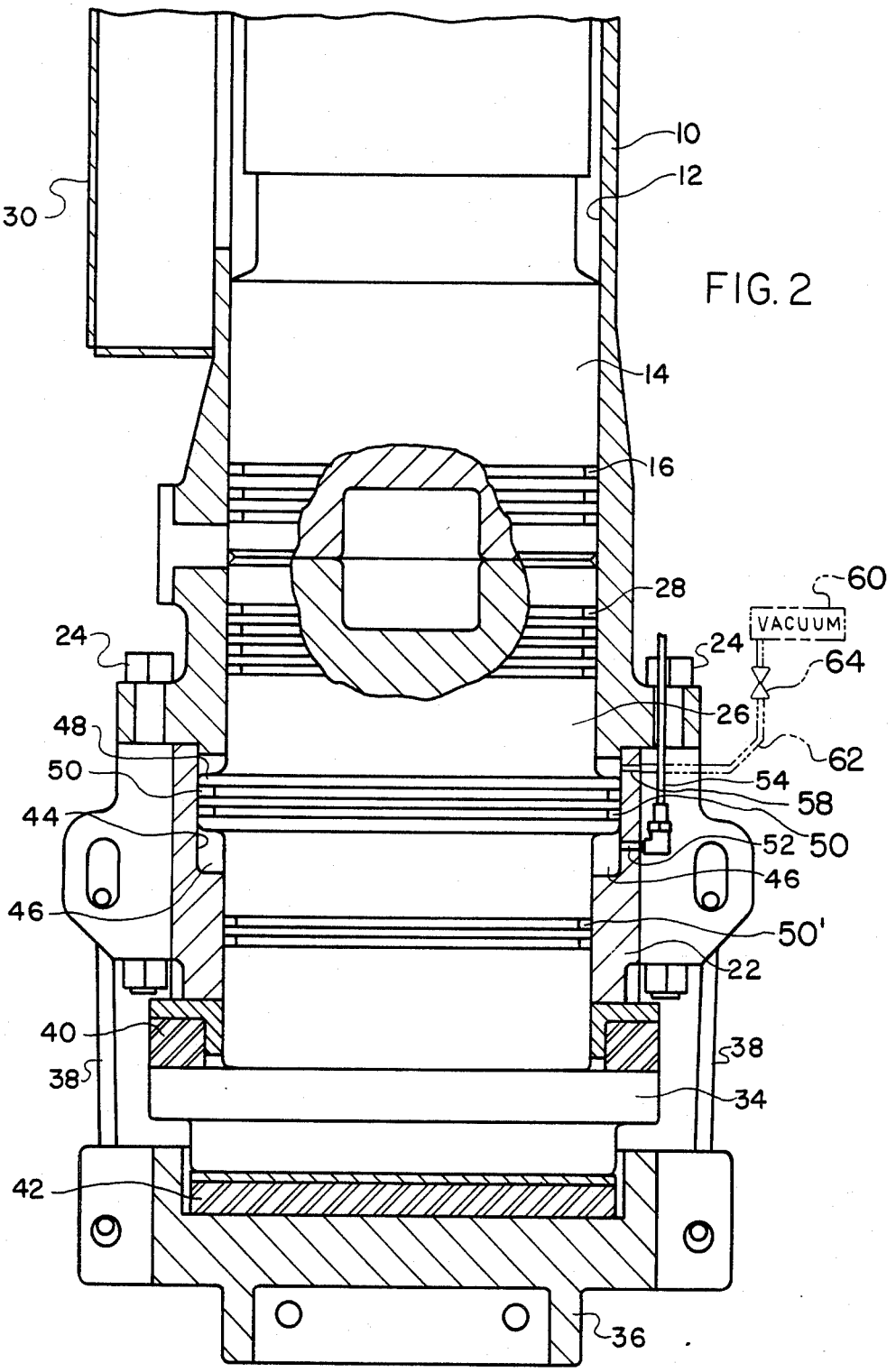
FIG. 2 is an enlarged detail view, also in diagrammatic form, showing the lower end of the power hammer in partial vertical section.

When the power hammer is used to drive piles and the like, a striker block 34 and drive cap base 36 may be held in place beneath the housing 10 by retainer rope 38 as shown in FIGS. 1 and 2 to permit manipulation of the power hammer until the bottom face of the drive cap base 36 is situated to receive the top of the pile to be driven. When the drive cap base 36 is so situated, the retainer rope 38 has sufficient slack so that it will not restrict the downward movement of the anvil 26 or otherwise interfere with the normal pile driving operation of the power hammer. Preferably, a resilient recoil damper element 40 is interposed between the bottom end of the housing 10 and the striker block 34, and a resilient, impact-absorbing cushion 42 is interposed between the striker block 34 and the drive cap base 36.

The power hammer, as described to this point, is conventional, and reference may be made to the aforementioned U.S. Pat. Nos. 3,437,157 and 4,020,804 for a more complete description of the details of construction and the operation of equipment of this type, which are well known in the art. To briefly summarize the operation of the power hammer, the lifting cable 32 is initially and temporarily connected to the ram 14 to raise it to its uppermost position, after which it is released. The substantial weight of the ram 14 causes it to move downwardly in the bore 12 until it strikes the anvil 26, and the impact of this downward force is transmitted to the pile (not shown) through the striker block 30 and the drive cap base 34 which rests atop the pile. During the downward movement of the ram 14, the portion of the bore 12 between the ram 14 and the anvil 26 is essentially sealed by the sealing rings 16 and 28 and the air trapped therebetween is compressed. As the ram 14 nears the end of its downward strike, it activates a cam-operated fuel pump (not shown) which injects fuel from the fuel tank 20 into the combustion chamber formed between the bottom face of the ram 14 and the upper face of the anvil 26. The compression of the air by the descending ram 14 creates sufficient heat to ignite the fuel, and the resulting forces of combustion causes the ram to be pushed upwardly in the bore 12 until it reaches a position near the top thereof, whereupon the cycle repeats itself. During this upward movement of the ram 14, air in the bore 12 above the ram 14 is forced into the compression cylinder 18 and compressed, and this compressed air is then utilized to assist in causing the ram 14 to move downwardly again in the bore 12, thereby shortening the stroke of the ram 14 and the length of the housing 10 as discussed above.

It will be appreciated that during the upward movement of the ram 14, the resulting compression of air in the compression chamber 18 creates an upwardly directed lifting force that is imposed on the top of the housing 10 and that has a tendency to lift the power hammer off of the pile engaged by the drive cap base 34. Moreover, since the anvil 26 is slidably carried in the bore 12 and simply rests upon the striker block 30 and its associated drive cap base 34, neither of which is integrally fixed to the housing 10, it will also be appreciated that the weight of the anvil 26 will not be part of the effective weight of the power hammer which opposes the upwardly directed lifting force caused by the ascendency of the ram 14.

In accordance with the improvement of the present invention, the weight of the anvil, or at least some significant portion of such weight, is effectively added to the weight of the housing 10 to resist the aforesaid upwardly directed lifting force. As best seen in FIG. 2, the interior wall of the anvil retainer 22 is formed with an annular recess 44 which, with the exterior wall of the anvil 26, forms an enclosed chamber 46, and the anvil 26 is formed with a radially projecting annular flange 48 that projects into the recess 44 and that includes sealing rings 50 for sealing engagement with the surface of the recess 44. Additionally, sealing rings 50′ are added to the lower portion of anvil 26 so that the sealing rings 50 and 50′ will seal the chamber 46 against the leakage of air therefrom. An opening 52 extends through the wall of the anvil retainer 22 at a location just below the flange 48 when the anvil 26 is at its normal or predetermined at-rest position as shown in FIG. 2, and this opening 52 is connected to a conduit 54 which extends upwardly to the compression cylinder 18 as illustrated in FIG. 1. A one-way check valve 56 may be located in the conduit 54 to permit the flow of air only in a direction from the compression cylinder 18 to the enclosed chamber 46 when the pressure in the former exceeds that in the latter, and prevents air flow in the opposite direction. However, this check valve 56 is not essential and can be eliminated in some applications of the present invention. A second opening or vent 58 is provided in the wall of the anvil retainer 22 adjacent the upper portion of the recess 44 so that it is open to atmospheric pressure.

In operation, when the ram 14 is moved upwardly in the bore 12, it creates air pressure in the compression cylinder 18, as described above, which is transmitted through the conduit 54 and check valve 56 to the enclosed chamber 46. The air pressure in the chamber 46, acting between the flanges 48 of the anvil 26 and the bottom surface of the recess 44 in the anvil retainer 22, has the effect of creating a force that opposes the tendency of the housing 10 to move upwardly under the influence of the air compression being generated in the compression cylinder 18 by the ascending ram 14. The magnitude of this opposing force will depend upon the area of the bottom surface of the flange 48 and the magnitude of the air pressure in the enclosed chamber 46, up to a maximum force equal to the dead weight of the anvil 26. In many applications of the power hammer, an opposing force equal to the entire weight of the anvil may not be necessary, in which case some desired lesser force may be used. Thus, in a typical example, if the anvil 26 weighs 3100 pounds and the maximum air pressure generated in the enclosed chamber 46 is 18 psi, the total area of the bottom surface of the flange 48 may be selected as 115 square inches, in which case the maximum force opposing upward movement of the housing 10 would be 2,070 pounds, which is less than the total dead weight of the anvil 26.

It will also be noted that if any of the pressurized air in the enclosed chamber 46 should leak past the sealing rings 50 on the annular flange 48, it will not create any opposing foce in the top portion of the recess 44 above the flange 48 because of the vent opening 58.

When the ram 14 descends and strikes the anvil 26, the impact, which is transmitted to the pile through the anvil 26, the striker block 34 and the drive cap base 36, will also tend to move the anvil 26 downwardly with respect to the anvil retainer 22, and in situations where the resistance to driving the pile is low, such as when the pile is being driven into relatively soft earth, the anvil 26 will tend to move downwardly to an extent that the flange 48 will strike the bottom wall of the recess 44, thereby imposing an impact load on the flange 48 as well as the bolts 24 which secure the anvil retainer 22 to the housing 10. However, in the present invention it will be noted that any significant downward movement of the anvil 26 with respect to the anvil retainer 22 will result in the flange 48 covering the opening 52, or being located therebeneath, so that the air in the enclosed chamber 46 is completely trapped to form an air cushion that will absorb some or all of the impact force that would otherwise result from the downward movement of the anvil 26. Moreover, once the ram 14 has completed its impact stroke, the housing 10 will move downwardly under its own weight in sliding relation to the anvil 26, whereupon the flange 48 will return to its initial position relative to the fluid opening 52, as shown in FIG. 2, and any loss of air pressure in the enclosed chamber 46 will be made up through the fluid opening 52 during the next upward stroke of the ram 14.

In an alternative embodiment of the present invention, the opening 58, which is above the flange 48, may be connected to a convenient vacuum source 60 by a fluid line 62 and a control valve 64 so as to create a negative pressure in the chamber above the flange 48 and thereby impose a lifting force on the anvil 36 during upward movement of the ram 14. This negative pressure can be applied simultaneously with the positive pressure created by the pressurized air in chamber 46, or it can be applied without such positive pressure, in which case the chamber 46 would be vented to atmosphere and the negative pressure would create the entire upwardly directed force imposed on the anvil 36.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A power hammer device for driving piles and the like including a housing in which a ram is arranged for reciprocating vertical movement to strike, during its downward movement, an anvil slidably carried within the lower portion of said housing, and including combustion means operative upon said ram striking said anvil to propel said ram upwardly and a compression cylinder associated with said housing in communication with the portion thereof above said ram to receive and compress air within said compression cylinder during upward movement of said ram, the improvement comprising an enclosed air chamber defined cooperatively by said housing and said anvil with at least a portion of said enclosed chamber disposed beneath a portion of said anvil, and conduit means providing direct fluid communication between said compression cylinder and said enclosed chamber for admitting said compressed air from said compression cylinder to said enclosed chamber whenever the pressure in said compression cylinder is greater than the pressure in said enclosed chamber to impose an upwardly directed force on said anvil during upward movement of said ram.

2. A power hammer device as defined in claim 1 and further characterized in that said conduit means includes valve means for permitting air to flow from said compression cylinder to said enclosed chamber while preventing the flow of air from said enclosed chamber.

3. A power hammer device for driving piles and the like as defined in claim 1 and further characterized in that said housing includes an anvil retainer portion attached at the lower end of said housing and slidably carrying said anvil therein, and in that said enclosed chamber is formed by an annular recess provided in said anvil retainer and an annular flange extending radially from said anvil and into said annular recess.

4. A power hammer device for driving piles and the like as defined in claim 3 and further characterized in that said conduit means includes a fluid inlet opening extending to said enclosed chamber at a location just below a predetermined position of said annular flange of said anvil within said anvil retainer whereby downward relative movement of said anvil in said anvil retainer below said predetermined position will cause said annular flange to close said fluid inlet opening.

5. A power hammer device for driving piles and the like as defined in claim 3 and further characterized in that said annular flange is normally disposed within said annular recess intermediate the longitudinal extent thereof to form said enclosed chamber beneath said annular flange and to form a second chamber above said annular flange, and in that said second chamber is open to atmospheric pressure by a vent opening extending from said second chamber to the surrounding atmosphere.

6. A power hammer device for driving piles and the like as defined in claim 3 and characterized further in that said upwardly directed force on said anvil is less than the weight thereof.

* * * * *